US005763846A

United States Patent [19]

Madlener et al.

[11] Patent Number: 5,763,846

[45] Date of Patent: Jun. 9, 1998

[54] SWITCH WITH A GEOMETRICALLY REPRODUCIBLY PRECISE SWITCHING POINT

[76] Inventors: Wolfgang Madlener, Königsberger Strasse 20, 88212 Ravensburg, Germany; Wilfried Veil, Ludwig-Uhland-Strasse 3, 88214 Ravensburg, Germany

[21] Appl. No.: 589,606

[22] Filed: Jan. 22, 1996

[51] Int. Cl.[6] ..... H01H 3/16

[52] U.S. Cl. ..... 200/61.76

[58] Field of Search ..... 200/16 B, 16 F, 200/61.76–61.82, 520–534, DIG. 29, 276, 276.14, 277, 277.1

[56] References Cited

U.S. PATENT DOCUMENTS

| | | | |
|---|---|---|---|
| 2,606,980 | 8/1952 | Woofter | 200/16 B |
| 3,823,285 | 7/1974 | Dwyer | 200/DIG. 29 |
| 4,564,730 | 1/1986 | Tomizu et al. | 200/16 B |
| 4,681,994 | 7/1987 | Nagata et al. | 200/16 B |
| 4,795,863 | 1/1989 | Tomizu et al. | 200/16 B |

FOREIGN PATENT DOCUMENTS

| | | | |
|---|---|---|---|
| 1765746 | 8/1971 | Germany | H01H 13/52 |

*Primary Examiner*—J. R. Scott
*Attorney, Agent, or Firm*—Spencer & Frank

[57] ABSTRACT

An electrical switch has a geometrically reproducibly precise switching point. The switch includes a housing defining a bore therein; an electrically conductive ball disposed within the bore and movable therein; two contact elements fastened in the housing; an elastic element disposed in the housing for pressing the ball against the contact elements such that the ball rests against the contact elements at respective contact points thereby establishing an electrically conductive connection between the contact elements; a plunger element operatively contacting the ball and being movable for lifting the ball off from the contact elements counter to a pressing force of the elastic element for interrupting the electrically conductive connection between the contact elements; and an adjustment element operatively contacting the ball for limiting a margin of movement thereof in a direction essentially perpendicular both with respect to a longitudinal axis of the bore and with respect to an imaginary line connecting the contact points.

3 Claims, 1 Drawing Sheet

SWITCH WITH A GEOMETRICALLY REPRODUCIBLY PRECISE SWITCHING POINT

FIELD OF THE INVENTION

The invention relates to a switch with a geometrically reproducibly precise switching point.

BACKGROUND OF THE INVENTION

Various embodiments of switches with a geometrically reproducibly precise switching point have already been disclosed. Such switches are used for example in probes of measuring machines in order to be able to perform automatic monitoring of machining processes on numerically controlled machine tools. Another field of application is as a precise limit switch.

A switch of the type designated in the introduction, in which two contact pins are attached in parallel in a housing, is described in the DE 17 65 746. Furthermore, an electrically conductive ball is movably held in the housing in such a way that it can come into contact with the two contact pins and connects them in a conductive fashion. The ball is pressed against the contact pins by means of a spring. On the other hand, in the housing there is a displaceably guided plunger by means of which the ball can be pressed away from the contact pins counter to the spring force. The switching point is then reached when the ball no longer has any electrically conductive connection to at least one contact pin.

However, the geometric and reproducibility precision of the switching point of this switch is not precise enough for some applications. The reason for this is as follows. The ball which is held in a base in the housing and rests against the contact pins under the force of a spring is capable not only of executing a desired movement in the longitudinal direction of the plunger but also of changing its position along the parallel contact pins. Since the contact pins are generally arranged not exactly perpendicularly with respect to the longitudinal axis of the plunger and do not run exactly parallel with respect to one another either, when the position of the ball changes, its position in the direction of the longitudinal axis of the plunger also changes. The positions of the ball which may occur by chance during the measurement thus influence the switching point and limit the reproducible precision quite decisively.

SUMMARY OF THE INVENTION

It is the object of the invention to make available a ball switch having a geometrically reproducibly precise switching point on which the repeat accuracy is considerably improved.

This object is achieved by providing a switch which includes a housing defining a bore therein; an electrically conductive ball disposed within the bore and movable therein; two contact elements fastened in the housing; an elastic element disposed in the housing for pressing the ball against the contact elements such that the ball rests against the contact elements at respective contact points thereby establishing an electrically conductive connection between the contact elements; a plunger element operatively contacting the ball and being movable for lifting the ball off from the contact elements counter to a pressing force of the elastic element for interrupting the electrically conductive connection between the contact elements; and an adjustment element operatively contacting the ball for limiting a margin of movement thereof in a direction essentially perpendicular both with respect to a longitudinal axis of the bore and with respect to an imaginary line connecting the contact points.

According to an advantageous and expedient development of the switch of the present invention the adjustment element comprises an adjustment screw having a longitudinal axis extending essentially perpendicularly both with respect to the longitudinal axis of the bore and with respect to the imaginary line connecting the contact points.

According to yet another embodiment of the invention, the plunger element comprises a cylindrical plunger, the switch further comprising a prestressed ball guiding device operatively contacting the cylindrical plunger for guiding the cylindrical plunger during its movement in a direction parallel to the longitudinal axis of the bore.

The invention is initially based on the fact that the switch comprises a housing in which two contact elements are attached. Furthermore, the switch contains an electrically conductive ball which can move in a bore in the housing and can come into contact with both contact elements. An elastic element ensures that the ball is pressed against the contact elements. A plunger element guided in the housing permits the ball to be lifted off from the contact elements counter to the force effect of the elastic element. The core of the invention concerns a configuration where the ball is virtually incapable of moving in a direction which runs essentially perpendicularly with respect to the longitudinal direction of the plunger and essentially perpendicularly with respect to the line connecting the contact points of the two contact elements to the ball.The above is accomplished by an adjustment element which positions the ball against the wall of the bore,the position in which the ball touches the contact elements remains unchanged. Accordingly at least one great source of faults which has hitherto restricted the precision of repetitive measurements is eliminated.

It is particularly advantageous if the adjustment element is an adjustment screw whose axis extends in the direction of the ball mobility that is to be limited. This constitutes a comparatively simple and cost-effective solution for the guidance of the ball in accordance with the invention.

The plunger element, which acts on the ball, can also cause a switching imprecision in case of insufficient longitudinal guidance. A particularly advantageous embodiment of the invention therefore comprises a cylindrical plunger which is axially guided in the housing by means of a prestressed ball guiding means so that, even in the presence of a lateral stress, the plunger does not tilt.

BRIEF DESCRIPTION OF THE DRAWINGS

An exemplary embodiment of the invention is illustrated in the drawings. In the said where.

DETAILED DESCRIPTION OF THE INVENTION

Figure 2:
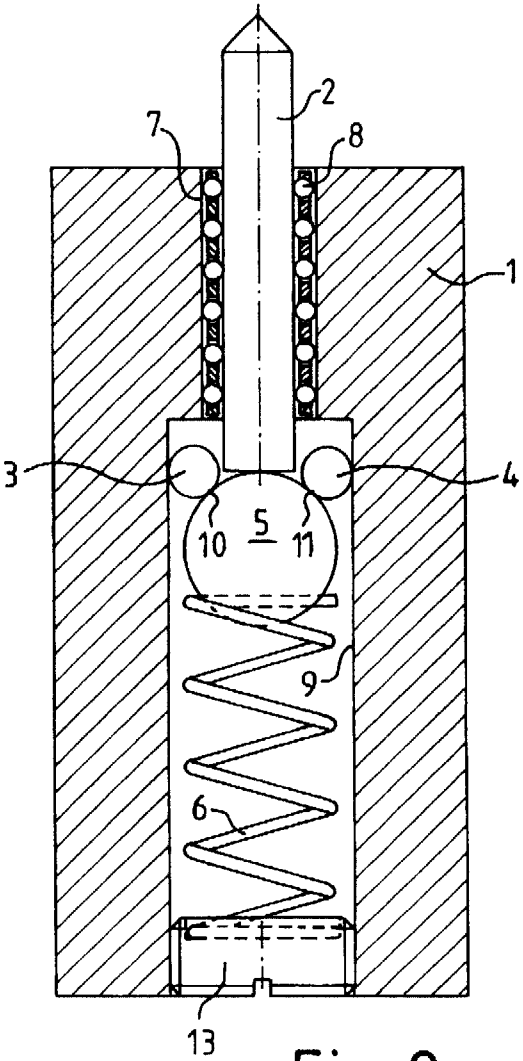
FIG. 2 shows the switch according to the FIG. 1 in the sectional side view, rotated through 90°.
Figure 1:
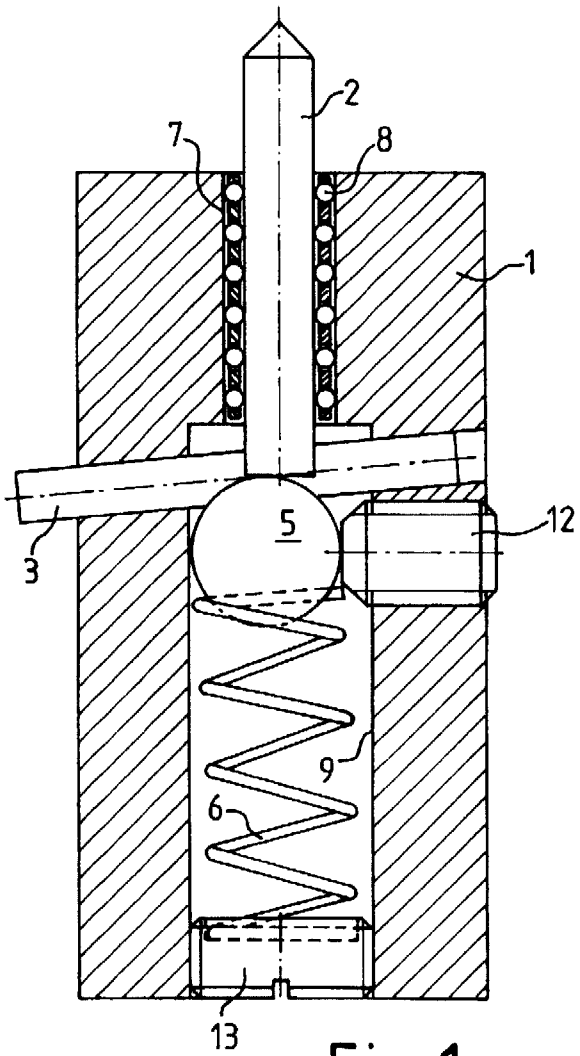
FIG. 1 shows a sectional side view of the switch according to the invention.

The exemplary embodiment in FIGS. 1 and 2 comprises a housing 1, a plunger element 2, two rod-shaped contact elements 3, 4, a conductive ball 5 and a helical spring 6. The plunger element 2 is located in a bore 7 in the housing and is guided by a prestressed ball guiding means 8 which permits a movement of the plunger element 2 only in its longitudinal direction. The upper end of the plunger element 2 protrudes beyond the housing 1, the lower end projecting into a bore 9 and at the same time resting on the ball 5. The ball 5 is in turn pressed against the contact pins 3, 4 at the contact points 10, 11 by the spring 6. The contact pins 3, 4 run essentially parallel and more or less perpendicularly with respect to the longitudinal direction of the plunger element 2 which direction corresponds to the direction of the axis of bore 9 as shown. In the present case the contact pins are slightly tilted to the left, as can be seen in FIG. 1. An adjustment screw 12 ensures that the ball 5 is pressed against the wall of the bore 9 in the direction of the longitudinal axes of the contact pins, specifically in such a way that a movement of the ball in the longitudinal direction of the plunger element is nevertheless possible. The ball is positioned against the contact pins 3, 4 by the contact points 10 and 11 in a uniquely defined fashion in a direction perpendicular with respect to the longitudinal axes of the contact pins and perpendicular with respect to the longitudinal direction of the plunger element.

The ball 5 can be moved, for example, into the most favorable position by means of the following procedure. During a measurement of the passage of electricity between the contact pins, the adjustment screw 12 is screwed in until the contact is interrupted at one contact pin. Subsequently, the adjustment screw is turned back by a small angular setting (for example a quarter rotation of the screw, depending on the thread pitch). In this position, the ball must rest against both contact pins 3, 4 again, that is to say be in electrical contact, and additionally it must be ensured that the ball is capable of moving in the longitudinal direction of the plunger element 2.

However, the contact between the ball and the contact pins is not always interrupted when the adjustment screw 12 is screwed in. For example, it is not interrupted if, by chance, the contact pins are exactly parallel during production and also run exactly perpendicularly with respect to the longitudinal direction of the plunger element. In this case, the adjustment screw must be retracted until the point where ball 5 can be moved freely again in the longitudinal direction of the plunger element 2 by spring 6 as shown.

The contact force of the helical spring 6 is absorbed by a screwed-in closure cap 13 on the side lying opposite the ball.

We claim:

1. An electrical switch having a geometrically reproducibly precise switching point comprising:

a housing defining a bore therein;

an electrically conductive ball disposed within the bore and movable therein;

two contact elements fastened in the housing;

an elastic element disposed in the housing and adapted to press the ball against the contact elements such that the ball rests against the contact elements at respective contact points thereby establishing an electrically conductive connection between the contact elements;

a plunger element operatively contacting the ball and being movable for lifting the ball off from the contact elements counter to a pressing force of the elastic element for interrupting the electrically conductive connection between the contact elements; and an adjustment element operatively contacting the ball for limiting a margin of movement thereof in a direction essentially perpendicular both with respect to a longitudinal axis of the bore and with respect to an imaginary line connecting the contact points.

2. The electrical switch according to claim 1, wherein the adjustment element comprises an adjustment screw having a longitudinal axis extending essentially perpendicularly both with respect to the longitudinal axis of the bore and with respect to the imaginary line connecting the contact points.

3. The electrical switch according to claim 1, wherein the plunger element comprises a cylindrical plunger, the switch further comprising a prestressed ball guiding device operatively contacting the cylindrical plunger for guiding the cylindrical plunger during its movement in a direction parallel to the longitudinal axis of the bore.

* * * * *